United States Patent [19]

Yagishita et al.

[11] 4,451,298

[45] May 29, 1984

[54] METHOD AND SYSTEM FOR RECYCLING WASHING LIQUIDS AND THE HEAT CONTAINED THEREIN

[75] Inventors: Aisaburo Yagishita, Nagoya; Noboru Mori, Inuyama; Kinshiro Kusumi, Konan; Yoshio Tsugi, Nagoya, all of Japan

[73] Assignee: Kabushiki Kaisha Sanshin Seisakusho, Nagoya, Japan

[21] Appl. No.: 328,498

[22] Filed: Dec. 8, 1981

[51] Int. Cl.[3] ..... B08B 7/04

[52] U.S. Cl. ..... 134/10; 134/13; 134/60; 134/90; 134/107; 134/108; 134/109; 134/111

[58] Field of Search ..... 134/10, 13, 60, 90, 134/105, 107, 108, 109, 110, 111

[56] References Cited

U.S. PATENT DOCUMENTS

| | | | |
|---|---|---|---|
| 2,234,593 | 3/1941 | Ferm et al. | 134/107 X |
| 2,949,119 | 8/1960 | Smith | 134/108 X |
| 3,100,727 | 8/1963 | Labergere | 134/107 X |
| 4,156,621 | 5/1979 | Andrews et al. | 134/10 |
| 4,333,485 | 6/1982 | Karlsson et al. | 134/60 |

*Primary Examiner*—Marc L. Caroff

[57] ABSTRACT

A system for recovery and recycling of a washing liquid and heat contained in the washings discharged from a metal surface treatment process comprises a hot water washing tank with an associated cushion tank, a cold water washing tank with an associated cushion tank, a heat exchanger, an ion exchanger and a filter. The second-mentioned cushion tank is in communication with the hot water washing tank through the heat exchanger, while the first-mentioned cushion tank is in communication with the cold water washing tank through the filter, the heat exchanger and the ion exchanger.

7 Claims, 4 Drawing Figures

METHOD AND SYSTEM FOR RECYCLING WASHING LIQUIDS AND THE HEAT CONTAINED THEREIN

BACKGROUND OF THE INVENTION

The invention relates to a method for recovering and recycling of washing liquids and the heat contained in the washings discharged from metal surfacing processes, and is concerned with a system for effecting such a method as well.

In the conventional chemical metal surface treatment processes, one of which is typically illustrated in FIG. 1, the quality of the cold washing water and the hot water in tanks 16 and 1 has to be kept constant by supply of a given amount of water and its discharge from the tanks involved by overflow means. More specifically, fresh steam 2 is fed from a boiler directly or indirectly into hot water washing tank to maintain the temperature therein, and the resulting hot water is discharged as such, i.e., without being subjected to any heat recovery treatment. This poses a problem in connection with the effective use of water resources and energy savings.

SUMMARY OF THE INVENTION

This invention has been accomplished with a view to providing a solution to the aforesaid problem.

A main object of this invention is therefore to provide a method and system which combine recycling of washing liquids with heat recovery.

Another object of this invention is to stabilize the quality of water supplied into and held in water and hot water washing tanks for the purpose of preventing deterioration of the metal products to be treated due to variations in quality of the water contained therein.

According to one aspect of the invention, there is provided a method for recovery and recycling of the washing liquid and the heat contained in the washings discharged from the chemical metal surface treatment process, which comprises permitting cold water (about 40° C.) discharged from a cold water washing tank to exchange heat with hot (about 80° C.), pure water before its introduction into a hot water washing tank, filtering the washings discharged from the hot water washing tank, subjecting the resulting filtrate to heat exchange and ion exchange to obtain pure water, and feeding the pure water back to the cold water washing tank.

According to another aspect of the invention, there is provided a method for recovery and recycling of the washing liquid and the heat contained in the washings discharged from a metal surface treatment process, which comprises allowing hot water discharged from a hot water washing tank to exchange heat with cold, pure water before its introduction into the cold water washing tank, filtering the liquid discharged from said water washing tank, subjecting the resulting filtrate to ion exchange to obtain pure water, heating the obtained pure water through heat exchange with said hot water, and feeding the thus heated water back to said hot water washing tank.

According to still another embodiment, there is provided a method for recovery and recycling of the washing liquid and the heat contained in the washings discharged from a metal surface treatment process, which comprises subjecting hot water discharged from a hot water washing tank for storing the second washings obtained in said process to heat exchange with cold, pure water to obtain cold water, introducing the obtained cold water into a cushion, buffer or holding tank together with impurities-containing cold water coming from a water washing tank for storing the first washings obtained in said process, filtering the liquid contained in said cushion tank, subjecting the resulting filtrate to ion exchange to obtain pure water, and heating a part of said pure water through heat exchange with said hot water for its feedback or recycling to said hot water washing tank while feeding another part of said pure water to said water washing tank without application of heat.

BRIEF DESCRIPTION OF THE DRAWINGS

The above-mentioned and other objects and advantages of the invention will become apparent from a reading of the following detailed description with reference to the drawings, in which.

DETAILED EXPLANATION OF PREFERRED EMBODIMENT

Figure 1:
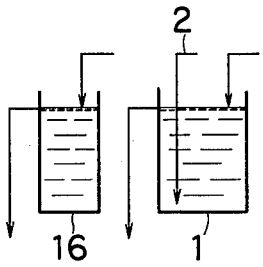
PRIOR ART FIG.1
FIG. 1 is schematically illustrative of a typical washing device used with the prior art metal surface treatment process.
Figure 2:
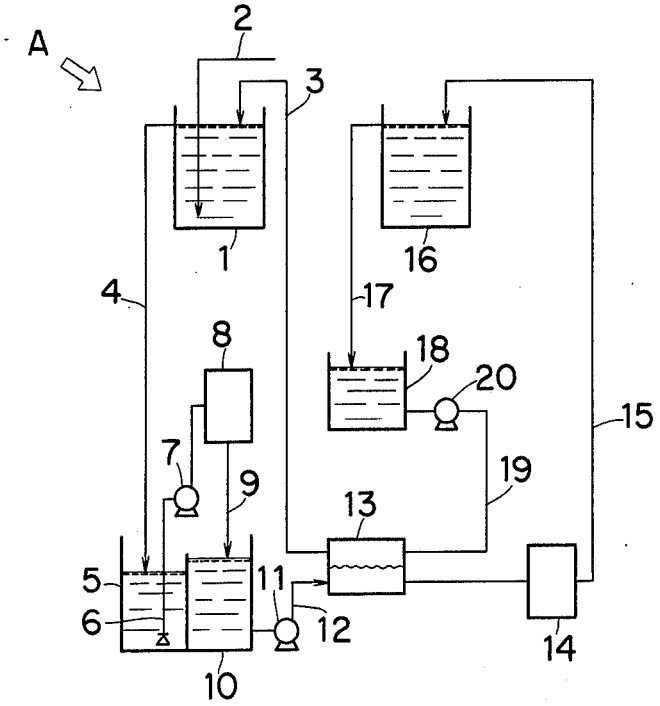
FIG. 2 is schematically illustrative of one embodiment of the system of this invention for recycling of washing liquids and heat contained in the washings discharged from the metal surface treatment process.

Referring now to FIG. 2, a hot water washing tank 1 includes therein a fresh steam inlet pipe 2, and has a hot water recovery pipe 3 located on one side and a hot water discharge pipe 4 on the other side. The other end of pipe 4 is then in communication within cushion tank 5.

The cushion tank 5 includes therein a water suction pipe 6 which extends through a pump 7 to a filter 8.

The filter 8 communicates with a filtrate reservoir 10 via a discharge pipe 9.

The filtrate reservoir 10 is in communication with a pipe 12 having a pump 11 on its way, which pipe passes through heat exchanger 13.

Part of the pipe 12 which leaves the exchanger 13 terminates in an ion exchanger 14. A cold water recovery pipe 15 then connects the ion exchanger 14 to cold water washing tank 16.

The cold washing tank 16 is connected on its one side with one end of a cold water discharge pipe 17 which is, in turn, connected on its other end within a cushion tank 18.

Communication is made between the cushion tank 18 and a pipe 19 passing through the heat exchanger 13, said pipe 19 having a pump 20 on its way. The pipe 19 is also connected with the hot water recovery pipe 3.

In what follows, the inventive method of recovery and recycling of the washing liquids and the heat contained in the washings will be explained with reference to the thus arranged recycling system shown generally at A.

In the process for repeating a cycle wherein the surface of a metal to be treated is washed in the hot water washing tank 1 and, then, in the cold water washing tank 16, circulation of a washing liquid is first effected through the system A.

The cold water washing tank 16 discharges contaminated cold water (ca. 40° C.) which passes through the pipe 17, cushion tank 18, and pipe 19 and exchanges heat with hot, pure water in the heat exchanger 13 with the resulting hot water (ca. 80° C.) being fed into the hot water washing tank 1.

The tank 1 discharges hot water containing contaminants into the cushion tank 5 through the pipe 4. Subsequently, the hot water is supplied from the suction pipe 6 into the filter 8 via the pump 7, where it is filtered off. The resulting filtrate is discharged into the reservoir 10 via the pipe 9.

The filtrate which leaves the reservoir 10 is supplied into the heat exchanger 13 via the pipe 12 by means of the pump 11, where it exchanges heat with cold water. The filtrate which is now adjusted to a temperature suitable for ion exchange is fed into the ion exchanger 14.

The ion exchanger 14 permits removal of cations ($Ca^{++}$, $Na^{+}$, etc.) and anions ($SO_4^{--}$etc.) contained in the filtrate through ion exchange until it is converted into pure (salt-free) water.

Cold water (approx. 35° C.) which is now converted into pure water through ion exchange is fed back into the cold water washing tank 16 through the pipe 15 for recovery. For circulation of the washing liquid, such operations are repeated.

Figure 3:
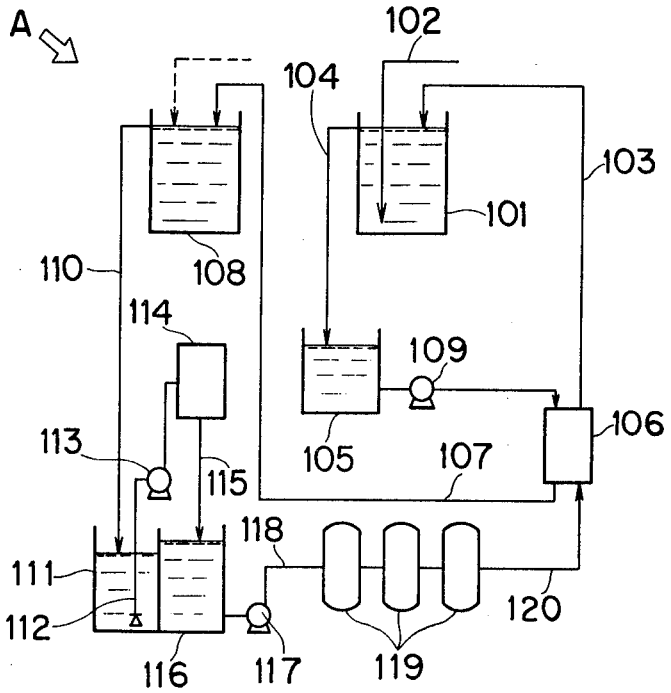
FIGS. 3 and 4 are schematically illustrative of second and third embodiments of the invention.

The objects of the present invention can also be achieved by starting with the hot water discharged from the hot water washing tank in the above-mentioned recycling process of washing liquids and heat. In what follows, this will be explained with reference to FIG. 3.

A hot water washing tank 101 includes therein a fresh steam inlet pipe 102, and has recovered hot water make-up pipe 103 located on one side and a hot water discharge pipe 104 on the other side. The other end of the pipe 104 is in communication within a cushion tank 105.

The cushion tank 105 communicates with one side of cold water washing tank 108 via a pipe 107 passing through a heat exchanger 106. A pump 109 is mounted on the pipe 107 between the tank 105 and the heat exchanger 106.

A cold water discharge pipe 110 communicates at its one end with the other side of the washing cold tank 108 and at its other end with a cushion tank 111.

The cushion tank 111 includes therein a water suction pipe 112 which terminates in a filter 114 via a pump 113.

The filter 114 communicates with a filtrate reservoir 116 via a discharge pipe 115.

The reservoir 116 communicates with an ion exchanger 119 via a pipe 118 having a pump 117 on its way.

The ion exchanger 119 communicates with a pipe 120 passing through the heat exchanger 106, said pipe 120 being connected with the hot water recovery pipe 103. In this way the washing liquid and heat recycling system, generally shown at A, is assembled.

Operation of the thus arranged system A will be explained.

In the operation for repeating a cycle wherein the surface of a metal to be treated is washed in the cold water washing tank 108 and, then, in the hot water washing tank 101, circulation of a washing liquid is first effected through the system A.

The hot water washing tank 101 discharges contaminated hot water (ca. 80° C.) which passes through the pipe 104, cushion tank 105 and pipe 107 and exchanges heat with cold, pure (salt-free) water in the heat exchanger 106 with the resulting purified cold water (ca. 40° C.) being fed into the cold water washing tank 108.

The tank 108 discharges cold water containing contaminants into the cushion tank 111 through the pipe 110. Subsequently, the cold water is supplied from the suction pipe 112 into the filter 114 via the pump 113, where it is filtered from contaminents. The resulting filtrate is discharged into the reservoir 116 via the pipe 115.

The filtrate adjusted to a temperature suitable for ion exchange, leaves the reservoir 116 is supplied into the ion exchanger 119 via the pipe 118 by means of the pump 117. This ion exchanger functions in the same manner as mentioned in connection with the ion exchanger 14.

Cold water (approx. 35° C.), now converted into pure (salt-free) water through ion exchange, is fed into the heat exchanger 106, where it exchanges heat with the above-mentioned hot water (approx. 80° C.) containing contaminants, and becomes pure water (approx. 75° C.). This pure water is then brought to a higher temperature by fresh steam or other means.

Better results are obtained if some modifications are made to the foregoing second embodiment. This will now be explained with reference to FIG. 4.

Figure 4:
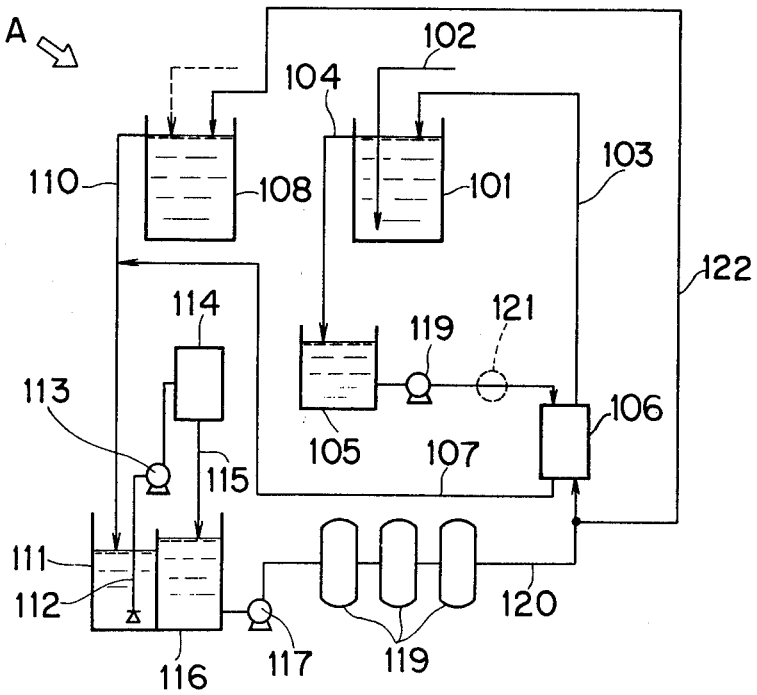

As will seen from FIG. 4, the third embodiment is similar to the second embodiment except for the provision of a bypass pipe 122 extending from between the heat exchanger 106 and the ion exchanger 119 into the cold water washing tank 108. If desired, a filter 121 may be disposed between the pump 109 and the heat exchanger 106 to prevent the exchanger 106 from being scaled or corroded.

The third embodiment works in a manner that is explained with reference to the second embodiment, except that a part of pure water obtained by ion exchange is fed back to the hot water washing tank 101 via the heat exchanger 106, while another part of pure water is fed back to the cold water washing tank 108 through the bypass pipe 122. More specifically, an amount of cold water (ca. 35° C.) obtained by ion exchange and converted into pure water is supplied into the heat exchanger 106, where it exchanges heat with the hot water (ca. 80° C.) containing impurities and becomes pure water having a temperature on the order of about 75° C. This pure water is then fed back to the hot water washing tank 101 and brought to a higher temperature by fresh steam or other means. The remaining amount of pure water is fed back to the cold water washing tank 108 through the bypass pipe 122.

Reference will be made to the action and effect of the invention. With the embodiments according to the invention, a washing liquid is recycled many times with no need for a supply of a constant amounts of extra water as required in the prior art. This results in water savings and efficient washing. Alternate use of the cold water in the cold water washing tank and the hot water in the hot water washing tank for heat exchange also leads to simplification of in the equipment involved and decreases in the amount of steam introduced into the hot water washing tank, and is preferable in view of energy savings. In addition, the quality of the washing water in both tanks can be stabilized to prevent deterioration of the metal products to be treated. As there is no fear that clogging of the filtering material may take place, the operation for washing it can be simplified.

According to the invention, any steps for frequent supply of fresh water are dispensed with. There is also no need for providing the cold water and hot water washing tanks with effluent vessels or sumps for the purpose of allowing frequent discharge of washings or of emptying the tanks. Therefore, the inventive system can be made compact and operated in a simple manner and in a good working environment where there is little or no risk of washing water leaks. Furthermore, the adjustment of washing water to a temperature suitable for ion exchange (Ca 35°–40° C.) is done through heat exchange or the like, and the washing of the filtering material is considerably reduced.

Especially with the third embodiment of the invention, it is feasible to simultaneously feed pure liquids back to both the hot water washing tank and the cold water washing tank. This assures that the quality of the liquids contained in each tank is kept in a satisfactory state during operation of the system, leading to improvements in the quality and accuracy of the metal product treated.

While the invention has been described in detail and with reference to the specific embodiment thereof, it will be apparent to one skilled in the art that various changes and modifications can be made therein without departing from the spirit and scope thereof.

What is claimed is:

1. A method for recovering and recycling washing liquids and the heat contained therein, said liquids being used in chemical surface treatments requiring serial hot and cold water washes, in either order, said wash waters respectively overflowing from hot and cold water washing tanks as effluents which comprises the steps of (a) collecting and segregating said effluents;

(b) filtering contaminents from the first of said serial effluent wash waters;

(c) permitting the cold effluent wash water to exchange heat with the hot effluent wash water;

(d) introducing the filtrate at a temperature below about 40° C. into an ion exchanger to yield purified filtrate;

(e) feeding the exchange-heated water to the hot water washing tank;

(f) feeding the exchange-cooled water to the cold water washing tank.

2. The method according to claim 1 wherein the hot effluent water is filtered and heat exchanged with said cold effluent water prior to ion-exchange purification to form the cooled water feed.

3. The method according to claim 1 wherein the cold effluent water is filtered and ion exchanger-purified prior to heat exchanging with said hot effluent.

4. The method according to claim 1 wherein a portion of the cool, purified ion-exchanged water is heat-exchanged with the hot wash water effluent and said so heated portion is fed to said hot water washing tank; and the remaining portion of said cool, purified ion-exchanged water is fed to said cold water washing tank;

5. A system for recovering and recycling the washing liquids and heat contained therein according to the method of claim 1 which comprises the cold and hot water washing tanks, a first cushion tank connected to said cold water washing tank for receiving cold effluent water therefrom and communicated with said hot water washing tank through a heat exchanger for heating the cold effluent water and cooling the hot effluent water, and a second cushion tank connected to said hot water washing tank for receiving hot effluent water therefrom and communicated with said cold water washing tank through a filter removing process contaminants, then through said heat exchanger for cooling the resultant hot filtrate and then through an ion exchanger for purifying the cool filtrate.

6. The system according to claim 5 wherein first cushion tank is connected to a filter for removing contaminants from said cold effluent and is communicated to an ion-exchanger for purifying the cool filtrate, before communicating with said heat exchanger.

7. The system for recovering and recycling washing liquids and the heat contained therein according to the system of claims 5 or 6 wherein the effluent from the ion exchanger is divided into first and second streams, said first stream consisting of a portion of the ion exchanger effluent being connected, to said heat exchanger to heat the cool purified liquid and then said heated first stream portion being directed to said hot water washing tank; said second stream containing the remaining portion of cool purified water being connected to said cold water washing tank.

* * * * *